US012778243B2

(12) United States Patent
Chaney

(10) Patent No.: US 12,778,243 B2
(45) Date of Patent: Nov. 3, 2026

(54) ANCHOR ATTACHMENT CLIP SYSTEM AND UTILIZING ENCLOSURE

(71) Applicant: HSG, LLC, Swansboro, NC (US)

(72) Inventor: Daniel Logan Chaney, Morehead City, NC (US)

(73) Assignee: HSG, LLC, Swansboro, NC (US)

( * ) Notice: Subject to any disclaimer, the term of this patent is extended or adjusted under 35 U.S.C. 154(b) by 194 days.

(21) Appl. No.: 18/947,776

(22) Filed: Nov. 14, 2024

(65) Prior Publication Data

US 2025/0151855 A1 May 15, 2025

Related U.S. Application Data

(60) Provisional application No. 63/599,115, filed on Nov. 15, 2023.

(51) Int. Cl.

| | |
|---|---|
| ***A44B 11/00*** | (2006.01) |
| ***A44B 11/14*** | (2006.01) |
| ***B65D 33/16*** | (2006.01) |

(52) U.S. Cl.

CPC ..... *A44B 11/006* (2013.01); *A44B 11/14* (2013.01); *B65D 33/1658* (2013.01)

(58) Field of Classification Search

CPC ..... F16B 5/12; A45F 5/02; A45F 5/00; A45F 5/1516; B65D 33/1658; A44B 11/006; A44B 11/14

See application file for complete search history.

(56) References Cited

U.S. PATENT DOCUMENTS

| | | | | |
|---|---|---|---|---|
| 3,296,673 | A * | 1/1967 | Kirkpatrick | B41F 27/1281 101/415.1 |
| 5,305,500 | A * | 4/1994 | Tucker | B65D 33/1675 24/30.5 R |
| 5,555,606 | A * | 9/1996 | Chu | B42F 1/02 24/563 |
| 6,018,850 | A * | 2/2000 | Lorber | B42F 1/02 24/67.9 |
| 7,805,815 | B2 * | 10/2010 | Babian | B60R 13/0206 24/297 |
| 7,866,515 | B1 * | 1/2011 | Buis, III | F41C 33/041 224/198 |
| 8,545,041 | B2 * | 10/2013 | Brown | F21V 21/0885 24/336 |
| 11,730,255 | B1 * | 8/2023 | Rubenzer | A45F 5/021 224/667 |

(Continued)

*Primary Examiner* — Derek J Battisti
(74) *Attorney, Agent, or Firm* — NK Patent Law

(57) ABSTRACT

An attachment clip system includes an attachment clip with an upper planar member, an extension member protruding from the bottom surface of the upper planar member, at least one lower planar member affixed to and extending from the extension member and disposed a distance from the upper planar member, and a channel defined in the distance between upper planar member and a portion of the surface of the lower planar member. The lower planar member has one or more catch projections disposed on a surface facing away from the upper planar member. The attachment clip is secured to a multilayered surface segment by insertion of the lower planar member into a first opening in an outer layer thereof and engagement of the catch projections with an offset aperture in an inner layer so that a portion of the outer layer is disposed in the channel.

21 Claims, 16 Drawing Sheets

(56) References Cited

U.S. PATENT DOCUMENTS

| | | | | |
|---|---|---|---|---|
| 11,992,097 | B1 * | 5/2024 | Wagner | A45F 5/021 |
| 2011/0036880 | A1 * | 2/2011 | Lee | A45F 5/02<br>224/269 |
| 2012/0175391 | A1 * | 7/2012 | Rogers | F41C 33/045<br>224/191 |
| 2022/0378181 | A1 * | 12/2022 | Cheng | A45F 5/1575 |

* cited by examiner

ANCHOR ATTACHMENT CLIP SYSTEM AND UTILIZING ENCLOSURE

CROSS-REFERENCE TO RELATED APPLICATIONS

This application claims priority to U.S. Provisional Patent Application 63/599,115 which was filed on Nov. 15, 2023, the entire contents of which is hereby incorporated by reference in its entirety.

TECHNICAL FIELD

The present disclosure relates to a system having an attachment clip utilized to provide a temporary stable anchor along a specific surface. More particularly, the present disclosure relates to an attachment clip that engages apertures in each two layers forming the specific surface that is particularly useful to secure retaining members, such as flaps, on enclosures, such as pouches and carrier devices.

BACKGROUND

Enclosures, such as bags, pouches, carriers, and other holders, are commonly utilized to move materials from one place to another. However, as anyone who has tried to fit a large item in a small bag can attest to, enclosures can be limited in the size and/or number of items that can be placed and carried therein securely. To enhance the utility of such enclosures, it is common for them to have retaining members, such as straps or flaps, to secure items therein. However, these retaining members are generally of limited use without the ability to fasten or secure such retaining members in place. For example, an ammunition/magazine carrying pouches generally can inadvertently spill items if a retaining member isn't secured over an opening therein. Generally, it is common for closures, such as buttons or hook-and-loop members to be utilized to temporarily secure a retaining member over an opening. However, one or more portions of these closures are generally affixed or disposed in set locations along the exterior of an enclosure, making it difficult for the enclosure and the retaining member to accommodate variously sized and shaped articles. This is particularly noticeable for ammunition magazine carrying pouches where portions of the magazine generally extend out of the opening of such a pouch for easier access. A different length magazine can prevent a retaining member from closing correctly and securing items there. Furthermore, most of these closures do not provide anchor points which might also be useful for temporarily securing items.

Moreover, these closures are often either slow and cumbersome to attach, tighten, or loosen, or are noisy when secured and unsecured. For example, snap fasteners and hook-and-loop fasteners are fast to open but often make significant noise. Additionally, straps and buttons, while quieter, can be slow and cumbersome. However, in certain instances, speed and silence are of particular importance. For example, a person momentarily hiding while trying to retrieve a can of mace from an enclosure pouch often wants to remain quiet and quickly access the can without fumbling around for it.

Accordingly, there exists a need for a temporary movable closure device which can anchor a retaining member, such as a flap, while providing for easy accommodation of various shapes and size items to be secured within an enclosure. Moreover, there also exists a need for a closure that makes less noise when secure and unsecured, without too much effort or delay in accessing the enclosure and items therein.

SUMMARY

This summary is provided to briefly introduce concepts that are further described in the following detailed descriptions. This summary is not intended to identify key features or essential features of the claimed subject matter, nor is it to be construed as limiting the scope of the claimed subject matter.

In at least one embodiment, an attachment clip system, that can provide a temporary stable anchor along a surface layer having at least a first layer with one or more outer apertures and second layer with one or more inner apertures offset from the outer apertures in a direction parallel to the first layer and second layer, has an attachment clip that includes an upper planar member with a top surface and a bottom surface joined by a perimeter edge, and a front end and an opposed back end. The attachment clip also includes an extension member, where the extension member has a first end that protrudes away from a portion of the bottom surface between the front end and back end of the upper planar member. The attachment clip also includes at least one lower planar member, each lower planar member including an inner surface and an outer surface joined together by a peripheral edge, and a forward end and an opposed rearward end, where the rearward end of each lower planar member is affixed to the extension member such that a segment of the bottom surface of the upper planar member and a section of the inner surface of the at least one planar member are disposed a space apart from each other. The attachment clip also includes at least one catch projection extending away from the outer surface; and a channel defined in the space between the bottom surface and the inner surface, the channel further defined by the extension member and an open terminus between the front end of the upper planar member and the inner surface of the lower planar member. In embodiments, the attachment clip is secured to the structure surface segment when each of the at least one lower planar member is inserted between the first layer and second layer through a respective outer aperture so that a respective catch projection is disposed within a respective inner aperture and a portion of the first layer is disposed within the channel.

In various embodiments, additional features or characteristics might be implemented. For example, the attachment clip may include a grip element disposed along the top surface of the upper planar member. Moreover, the grip element may include a depression into the top surface of the upper planar member in embodiments. Similarly, the grip element may include a ridge along the top surface of the upper planar member in particular embodiments. Also, the grip element, in certain embodiments, may include a shoulder disposed from the top surface adjacent to the perimeter edge.

In certain implementations, the upper planar member may be tapered such that a distance between the top surface and bottom surface at the rear end is greater than at the front end. Indeed, the channel may be tapered such that the distance between the bottom surface and the inner surface is greater adjacent the extension member than the terminus in embodiments.

In further embodiments, each lower planar member may extend away from the extension member a distance so that the forward end thereof is disposed on an opposed side of the terminus from the channel.

In further implementations, the forward end of each lower planar member may be wedge shaped. Further, the at least one catch projection may include one or more teeth in implementations. The at least one catch projection, in embodiments, may include a series of projections disposed in a line between the forward end and the rearward end. Moreover, the at least one lower planar member may include a first lower planar member and a second lower planar member where the rearward end of the first lower planar member is affixed to the extension member at a first location thereon and the rearward end of the second lower planar member is affixed to the extension member at an opposed second location thereon in embodiments.

In various implementations, the attachment clip may include a protuberance disposed along the bottom surface of the upper planar member at a location adjacent the back end. Further, the protuberance may include a tooth in certain embodiments. Indeed, the tooth is elongated between two opposed portions of the perimeter edge of the upper planar member in at least one embodiment. Thereby, an anchor surface is defined along a section of the bottom surface of the upper planar member between the extension member and the protuberance. In certain implementations, the surface layer includes a portion of an exterior wall of an enclosure. In implementations, the attachment clip system includes a retaining member having a first end affixed along an exterior of the enclosure on a side thereof opposite the portion of the exterior wall comprising the surface layer and further including a second end on an opposite side of retaining member from the first end thereof, and where the retaining member is secured to the attachment clip when a portion of the second end is disposed between the first layer and the anchor surface. In a particular implementation, at least a portion of the retaining member is stretchable, and the second end of the retaining member is biased into contact with the anchor surface to secure the retaining member in a position relative to the enclosure. In implementations, the second end of the retaining member includes a pull tab having an insert portion configured to mate within a space between the anchor surface and the first layer. Indeed, in certain implementations, the pull tab further includes an extension segment protruding away from the insert portion and configured so that movement of the extension segment away from the first layer generates movement of the insert portion out of the space between the anchor surface and the first layer.

In at least one embodiment, a carrier having a stable anchor feature also includes an enclosure defined by at least one exterior wall, where a portion of the exterior wall may include at least an exterior layer having a first opening and an interior layer having a first aperture, where the first opening and the first aperture are offset; an attachment clip may include a top planar member having a first end and an opposed second end and an extension member projecting from a first surface thereof between the first end and the second end. The attachment clip of the carrier also includes an insertable planar member affixed to the extension member and disposed a distance away from the first surface such that a channel is defined in the space between portions of the first surface between the extension member and the first end and a surface of the insertable planar member facing the first surface; at least one catch projecting from a surface of the insertable planar member on an opposed side thereof from the surface facing the first surface. The carrier also includes the insertable planar member disposed through the first opening such that a portion of the exterior layer is disposed within the channel to limit movement of the attachment clip and the catch engages the first aperture of the interior layer to secure the attachment clip, where an anchor passage is defined by a portion of the first surface between the second end and the extension member and a portion of the exterior layer adjacent the first opening.

In various embodiments, additional features or characteristics might be implemented. For example, the first opening may include a slit. Also, exterior layer may be a flexible material. Similarly, the exterior layer may include a fabric. Moreover, the interior layer may include a semi rigid panel. Indeed, at least one of the first opening and the first aperture are laser cut into their respective layers. Further, the exterior layer and interior layer may be stitched together along at least two opposed peripheral edges.

Also, the carrier may also include a stretchable retaining member having a first end affixed to the enclosure at a portion thereof on an opposite side of a mouth to the enclosure and having an opposed free second end, wherein the retaining member is secured over the mouth of the enclosure when the second end is inserted into the anchor passage and the retaining member is stretched to bias the second end within the anchor passage. In particular implementations, the second end includes a stretchable cord. In specific circumstances, the second end further includes a pull tab affixed to the stretchable cord. Indeed, in at least one circumstance, the pull tab has at least an insert portion that is shaped and sized to engage with the anchor passage. In fact, the pull tab may also include a segment that extends from the insert portion and articulation of the segment disengages the insert portion from the anchor passage. Moreover, the retaining member includes a flexible material flap between the first end and the second end in one implementation.

In at least one embodiment, a carrier having a stable anchor feature also includes an enclosure defined by at least one exterior wall and having a mouth, where a portion of the exterior wall may include at least an exterior layer having serially disposed openings and an interior layer having serially disposed pairs of apertures, where each of the openings is diagonally offset from one of the apertures; an attachment clip may include a top planar member having a first end and an opposed second end and an extension member projecting from a first surface thereof between the first end and the second end. The attachment clip of the carrier also includes two insertable planar members, each affixed to the extension member and disposed a distance away from the first surface such that a channel is defined in the space between portions of the first surface between the extension member and the first end and a surface of each of the insertable planar members facing the first surface; at least one catch projecting from a surface of each of the insertable planar members on an opposed side thereof from the surface facing the first surface; and where each insertable planar member is disposed through one of the openings such that a portion of the exterior layer is disposed within the channel to limit movement of the attachment clip and the catch of each of the insertable planar members engages one of a pair of apertures of the interior layer to removably secure the attachment clip, where an anchor passage is defined by a portion of the first surface between the second end and the extension member and a portion of the exterior layer adjacent the first opening.

The above summary is to be understood as cumulative and inclusive. The above-described embodiments and features are combined in various combinations in whole or in part in one or more other embodiments.

BRIEF DESCRIPTION OF THE DRAWINGS

The foregoing, as well as the following Detailed Description, is better understood when read in conjunction with the appended drawings. For the purposes of illustration, there is shown in the drawings exemplary embodiments; however, the presently disclosed subject matter is not limited to the specific methods and instrumentalities disclosed.

The embodiments illustrated, described, and discussed herein are illustrative of the present invention. As these embodiments of the present invention are described with reference to illustrations, various modifications or adaptations of the methods and or specific structures described may become apparent to those skilled in the art. It will be appreciated that modifications and variations are covered by the above teachings and within the scope of the appended claims without departing from the spirit and intended scope thereof. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated. Embodiments of the present invention are shown with reference to the following drawings introduced as follows:

DETAILED DESCRIPTIONS

Figure 1:
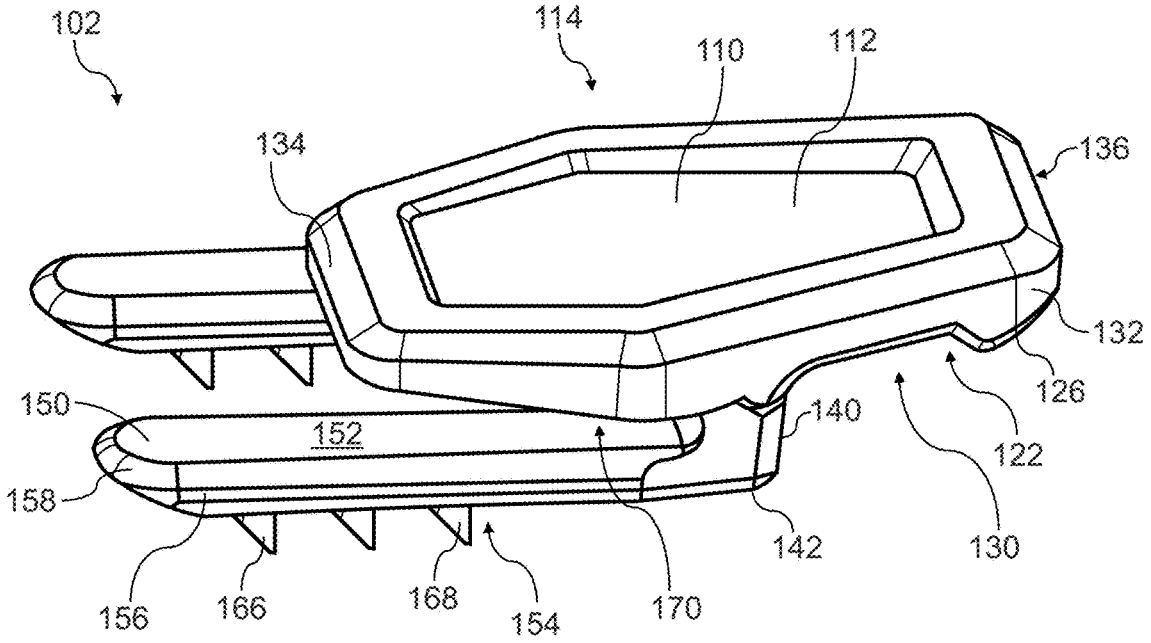
FIG. 1 illustrates an upper right front perspective view of an attachment clip according to one or more embodiments herein.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although steps may be expressly described or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Like reference numbers used throughout the drawings depict like or similar elements. Unless described or implied as exclusive alternatives, features throughout the drawings and descriptions should be taken as cumulative, such that features expressly associated with some particular embodiments can be combined with other embodiments.

System Generally

Figure 17:
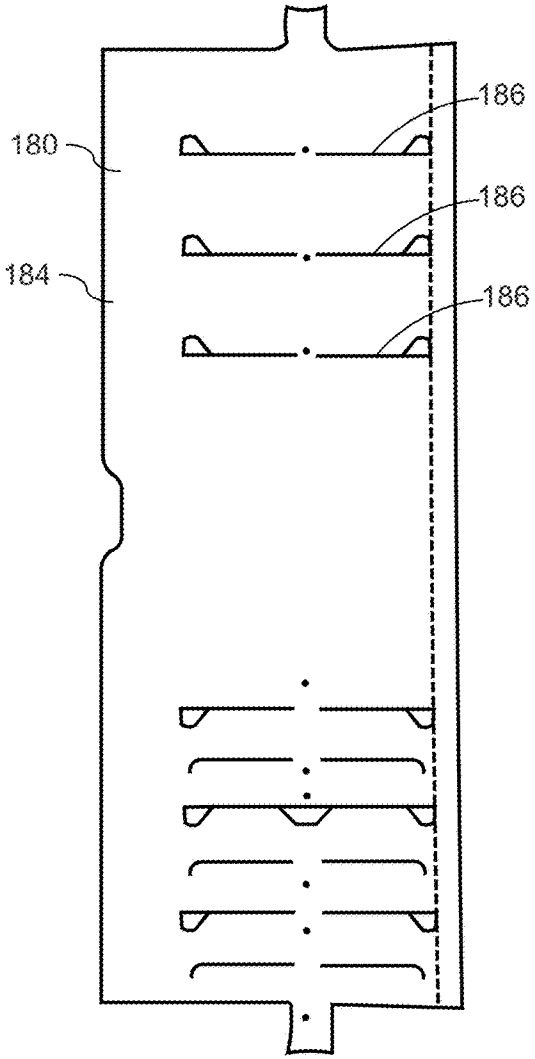
FIG. 17 illustrates an exterior side view of partially constructed surface layer, which can form all or a portion of an exterior wall of an enclosure, showing the first layer of a an enclosure according to the embodiment of FIG. 16 and showing outer apertures in the first layer into which lower planar members may be inserted so catch projections can engage the inner apertures and a portion of the first layer may be disposed within the channel when the attachment clip is secured.
Figure 16:
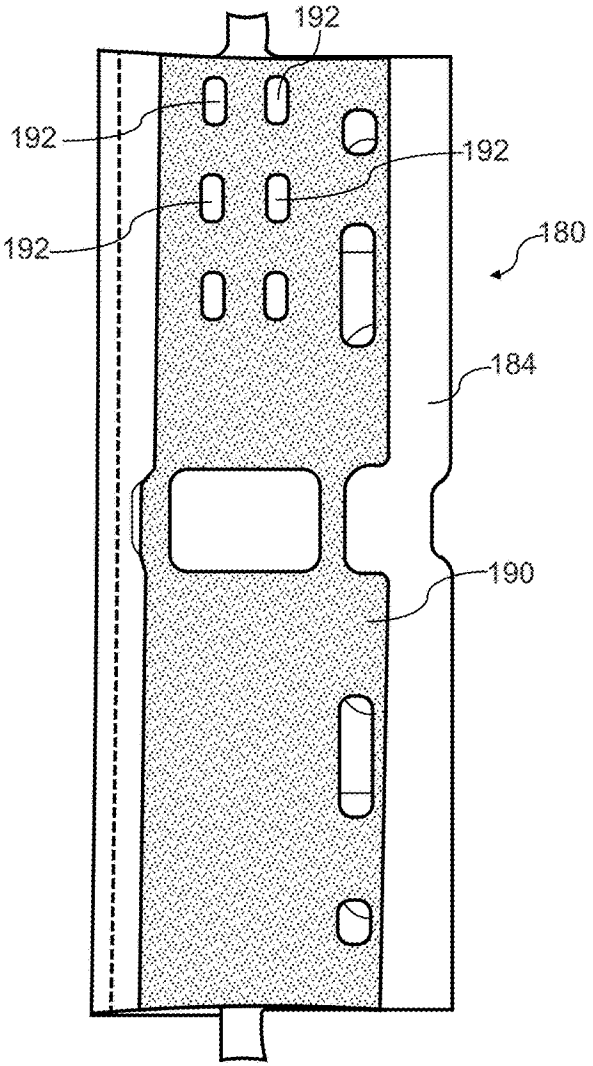
FIG. 16 illustrates an interior side view of partially constructed surface layer, which can form all or a portion of an exterior wall of an enclosure, showing the first and second layers thereof according to one or more embodiments herein showing the inner apertures in the second layer to which catch projections of the attachment clip engage when secured and showing one of the perimeter seams as would be utilized to fully attach the first layer and second layer.

Generally, the present disclosure concerns embodiments of an attachment clip system 100, such as that shown in FIGS. 6-15, that includes an attachment clip 102 that is removably securable to an surface layer 180 along an exterior wall 202 of an enclosure 200, such as a carrier, to provide a stable anchor 182 to which another portion of the enclosure 200, such as a retaining member 204, can be removably affixed to provide a quick and less noisy closure. In embodiments, the surface layer 180, such as that shown in FIGS. 16-17, generally includes at least two adjacent layers, a first layer 184 and a second layer 186, such as those shown in FIGS. 18-22. In embodiments, the surface layer 180 forms at least a segment of an exterior wall 202 of an enclosure 200. In embodiments, the first layer 184 has at least one outer aperture 186 and the second layer 190 has at least one inner aperture 192. In embodiments, the inner aperture 186 and outer aperture 192 are offset in a direction parallel to the first layer 184 and second layer 190.

The offset apertures form a pair to which the attachment clip 102 can utilize to be removably secured. In particular, the attachment clip 102 is removably secured in embodiments, when a portion of the attachment clip 102, specifically a lower planar member 150, is inserted in between the first layer 184 and second layer 190 through an outer aperture 186 so structures on the lower planar member 150 engage one or more inner apertures 192 on the second layer 190, as in FIG. 22, and so a portion of the first layer 184 is disposed within a channel 170 defined by portions of the attachment clip 102, as in FIGS. 6-7 and 9-15. However, in general, the surface layer 180 can have multiple pairs of offset apertures, whereby the attachment clip 102 can be disposed in multiple locations along a surface layer 180 to accommodate various sized objects in the enclosure 200, as shown in the comparison of FIGS. 7, 9, 10, and 14-15. Moreover, the attachment clip 102 has a portion, anchor surface 130, which defines a portion of an anchor passage 174 along with the first layer 184, that can accommodate a portion of a retaining member 204, such as an end 208 or an easily articulable pull tab 210 disposed at the end 208 thereof (shown in FIG. 24A-25C) in embodiments, such as shown in FIGS. 6, 11-13, and 23A-23C.

Elements

While various features and elements have been described in reference to particular embodiments and variations above, it is to be understood that no limitation of the scope of this disclosure is hereby intended. Thereby, elements and features might be utilized in any combination and for any embodiment to which it is particularly useful. To further promote understanding of the principles of the present disclosure, additional discussion related to particular elements of the present discussion is provided below.

Attachment Clip

In embodiments, the attachment clip system 100 includes an attachment clip 102, such as that shown in FIGS. 1-5. In embodiments, the attachment clip 102 includes an upper planar member 110 having a top surface 112 and bottom surface 122 joined by a perimeter edge 132, an extension member 140 having a first end 142 protruding downward and away from a portion of the bottom surface 122 of the upper planar member 110, and at least one lower planar member 150 affixed at a rearward end to the extension member adjacent the first end 142 such that a channel 170 is defined in the space between the bottom surface 122 of the upper planar member 110 and a portion of a surface of the lower planar member 150.

In addition, the lower planar member 150 of the attachment clip 102 includes an inner surface 152 facing the channel 170 and an outer surface 154 joined by a peripheral edge 156 in embodiments. Additionally, the lower planar member 150 includes a forward end 158 opposed to the rearward end 162 thereof and extending away from the forward end 158 and extension member 140. In embodiments, the lower planar member 150 includes one or more catch projections 166 extending away from the outer surface 154 thereof and from the other portions of the attachment clip 102.

Moreover, the upper planar member 110 further includes a front end 134 and a back end 136, the front end 134 being disposed along a portion of the perimeter edge 132 on a similar side of the attachment clip 102 as the forward end 158 of the lower planar member 150. The back end 136 of the upper planar member 110 is disposed along a portion of the perimeter edge 132 on a side of the upper planar member 110 opposite that of the front end 134. In embodiments, a portion of the bottom surface 122 of the upper planar member 110 between the extension member 140 and the front end 134 defines one portion of the perimeter of the channel 170. In embodiments, a portion of the bottom surface 122 between the extension member 140 and the back end 136 or protuberance 126 defines an anchor surface 130 that, along with the first layer 184 defines perimeter portions of an anchor passage 174.

In use, the attachment clip 102, such as that described above, is secured to a multi-layered surface, surface layer 180, by inserting the forward end 158 of the at least one lower planar member 150 into an opening (outer aperture 186), in an exterior first layer 184 and progression along a surface of the interior second layer 190 until the one or more catch projections 166 engage one or more inner apertures 192 defined in the second layer 190. Thereby, a portion of the exterior first layer 184 is inserted into the channel 170. Accordingly, both the engagement of the one or more catch projections 166 in the inner apertures 192 and location of a portion of the first layer 184 within the channel 170 serve to secure the attachment clip 102 in place from casual dislodgement. Indeed, the first layer 184 generally holds the lower planar member 150 in place relative to the second layer 190 after mating the one or more catch projections 166 with respective inner apertures 192. However, the attachment clip 102, can be purposefully disengaged through the pivoting of the attachment clip 102 relative to the second layer 190 to remove catch projections 166 from engagement with the inner apertures 192 and simultaneous lateral movement of the attachment clip 102 to remove the portion of the first layer 184 from the channel 170 and the forward end 158 of the lower planar member 150 from the outer aperture 186.

Upper Planar Member

In addition to the descriptions provided above, additional details regarding the upper planar member 110 are provided. In embodiments, the upper planar member 110 can have a grip element 114 along a top surface 112 to enhance the ability of a user to hold such a portion while securing or removing an attachment clip 102 as in FIGS. 1-3. Indeed, in embodiments, the grip element 114 can comprise a textured, or friction-enhanced surface. In further embodiments, the grip element 114 might include a depression 116 into the top surface 112 of the upper planar member 110. Moreover, the top surface 112 might—in alternative or in addition—include one or more ridges 118 as grip elements 114 in embodiments. Moreover, the top surface 112 might—in alternative or in addition—include multiple ridges 118 disposed around and adjacent to the edge of the top surface 112 to form a shoulder 120. In embodiments, the shape of the top surface 112 of the upper planar member 110 may enhance the ability of a user to hold such a portion. Indeed, the top surface 112 in FIG. 1 has an irregular hexagon shape that, in combination with the perimeter lined shoulder 120 thereupon provides an enhanced ability for a user to securely contact the surface 112 by providing a depression 116 that accommodates the rounded nature of a fingertip. However, in alternative embodiments, a top surface 112 of virtually any other shape may be utilized, including square, rectangular, or oval. The shape of the top surface 112 may be dependent upon the desired shape of the upper planar member 110 in embodiments. Moreover, the shape of the upper planar member 110 and the top surface 112 may be dependent upon the shape of a portion of the retaining member 204, such as a tab 210, so that a nested or more secure fit between the retaining member 204 and the upper planar member 110 is provided, as in the complimentary shapes of the upper planar member 110 and the tab 210 shown in FIGS. 23A-23C.

In further embodiments, the upper planar member 110 can also have a protuberance 126 extending from a bottom surface 122 thereof adjacent to the back end 136 as in FIGS. 1, 3-4, and 23C. This protuberance 126 may be a post, bar, or bump in various embodiments. However, in at least one embodiment it is an elongated tooth 128 extending between two portions of the perimeter edge 132. The protuberance 126 can provide a further structural feature to aid in securing a portion of the retaining member 204 in contact with an anchor surface 130 and within an anchor passage 174. Indeed, in embodiments, the protuberance 126 may have a mating segment of an insert portion 212 disposed along a pull tab 210 of a retaining member 204, as in FIGS. 23A-25C. In embodiments, the protuberance 126 can aid in preventing a retaining member 204 from being accidentally dislodged.

In additional embodiments, the upper planar member 110 may have a thickness between the top surface 112 and bottom surface 122 that tapers from the back end 136 to the front end 134 so that the upper planar member 110 is thicker near the back end 136 than the front end 134. Thereby, the upper planar member 110 may enhance durability and structural integrity of the upper planar member 110 against accidental dislodgement of a retaining member 204.

Extension Member

Figure 3:
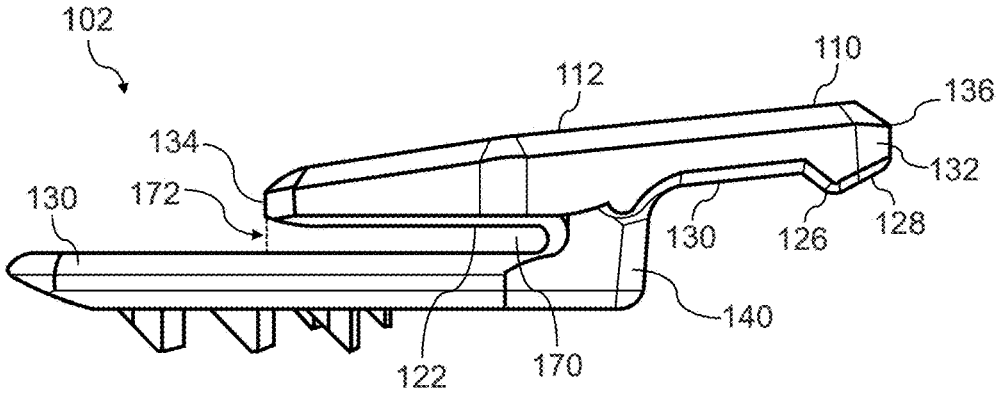
FIG. 3 illustrates a right-side elevation view of an attachment clip according to one or more embodiments herein.
Figure 4:
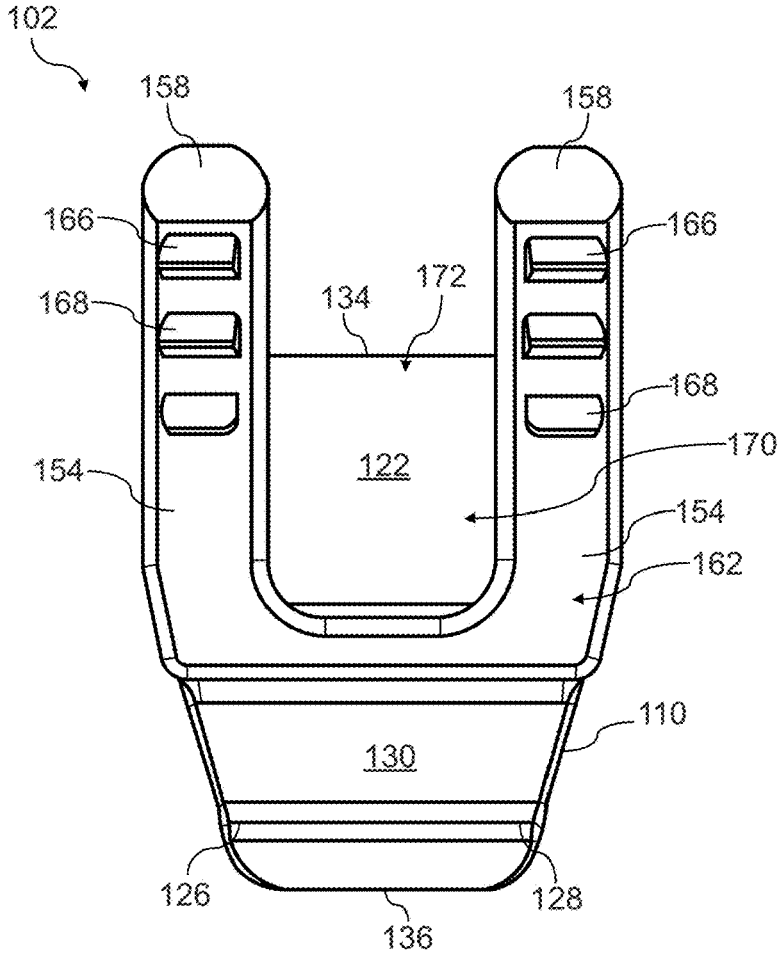
FIG. 4 illustrates a bottom plan view of an attachment clip according to one or more embodiments herein.

In addition to the descriptions provided above, additional details regarding the extension member 140 are provided. In embodiments, the attachment clip 102 has one or more extension members 140, as shown in FIG. 3, protruding away from a bottom surface 122 of the upper planar member 110 and connecting the upper planar member 110 and lower planar member 150 together so that a channel 170 is defined between the upper planar member 110 and lower planar member 150. As shown in FIG. 4, a single extension member 140 can serve as the connection point for more than one lower planar member 150 in embodiments. Indeed, the extension member 140 of FIG. 4 extends along a width of bottom surface 122 between two opposed portions of the perimeter edge 132 of the upper planar member 110 and provides opposed end portions to which the rearward ends 162 of the lower planar members 150 and from which the lower planar members 150 extend. Thereby, two lower planar members 150 are disposed a predefined distance apart from each other, as in FIG. 4, which can accommodate having midline stitching, as in FIGS. 14-15. Indeed, the midline stitching may act to resist inadvertent twisting of the attachment clip 102 relative to the surface layer 180, enhancing the stability of the attachment clip 102 when secured. Although two lower planar members 150 are shown in the embodiments of the figures, the extension member 140 may allow for attachment and arrangement of any number of lower planar members 150. Moreover, their arrangement may be predefined in embodiments to match structural features of the surface layer 180, such as stitching, outer apertures 186 and inner apertures 192. Indeed, as demonstrated in FIG. 22, the distance between the lower planar members 150 can be predefined to match the distance between outer apertures 186 or inner apertures 192 and may also allow for midline stitching, as in FIGS. 14-15.

Moreover, while one extension member 140 is shown in the figures, the attachment clip 102 might have more than one extension member 140 in embodiments. Indeed, in instances where the attachment clip 102 has more than one lower planar member 150, each lower planar member 150 may be affixed to a separate respective extension member 140 in embodiments. Further, in at least one embodiment, an attachment clip 102 may not have any extension member 140 at all. For example, a lower planar member 150 may be affixed directly to the bottom surface 122 of the upper planar member 110 and extend angularly away therefrom, such that the channel 170 formed has a V-shaped cross section in one dimension, and not necessitating an extension member 140. In instances where the attachment clip 102 has an extension member 140, one end of the channel 170 is defined by a surface of the extension member 140. Indeed, in embodiments, a portion of a surface of the extension member 140 may mark a boundary for the channel 170 opposite an open terminus end 172, generally adjacent to the front end 134 of the upper planar member 110.

Lower Planar Member

In addition to the descriptions provided above, additional details regarding the lower planar member 150 are provided. In embodiments, the attachment clip 102 also comprises at least one lower planar member 150, as shown in FIGS. 1-5. Indeed, in embodiments, the clip may have two lower planar members 150, as best shown in FIG. 4. Indeed, each of the lower planar members 150 can have a rearward end 162 affixed to different portions of an extension member 140 so that each are separated by a predefined distance in embodiments.

In embodiments, that separation distance is generally in a direction perpendicular to a direction defined between the front end 134 and back end 136 of the upper planar member 110 and/or perpendicular to a direction defined between the forward end 158 and rearward end 162 of the lower planar member 150 itself. That is, the extension member 140, in embodiments has a length defined in a direction between the front end 134 and back end 136, a width defined in a direction perpendicular to that and between two opposed perimeter edges 132 along a bottom surface 122 of the upper planar member 110 and a height defined in a direction downward away from the bottom surface 122 and the upper planar member 110. In embodiments, the rearward end 162 of each of two lower planar member 150 are affixed to the extension member 140 adjacent the height-wise defined first end 142 thereof and adjacent width-wise ends thereof, as shown in FIG. 4. Thereby, a space of predefined size is provided between the two lower planar members 150 that can accommodate surface layer 180 structures such as midline stitching, as in FIGS. 14-15. Indeed, the midline stitching may act to resist twisting of the attachment clip 102 relative to the surface layer 180 by limiting movement of each lower planar member 150, enhancing the stability of the attachment clip 102 when secured.

Although two lower planar members 150 are shown in the embodiments of the figures, the clip may accommodate any number of lower planar members 150 in embodiments. Moreover, their arrangement may be predefined in embodiments to match structural features of the surface layer 180, such as stitching, outer apertures 186, and inner apertures 192. Indeed, as demonstrated in FIG. 22, the separation distance between the lower planar members 150 matches the distance between inner apertures 192 and allows for midline stitching, as in FIG. 14, in embodiments.

Moreover, the attachment clip 102 may have any shape lower planar members 150 in embodiments, provided the arrangement of catch projections 166 along an outer surface 154 thereof and the dimensions of the lower planar members 150 match the arrangement and placement of apertures 186, 192 in the respective layers 184, 190 of the surface layer 180 to which it is to be attached. In embodiments, the lower planar members 150 may have a roughly rectangular column shape, as in FIG. 4. However, in alternative embodiments, the lower planar members 150 may have round, oval, triangular, or other shaped cross sections. Indeed, in one embodiment, the attachment clip 102 may have a single lower planar member 150 having a rectangular cross section, so there is no predefined space (such as the space shown in FIG. 4).

Figure 5:
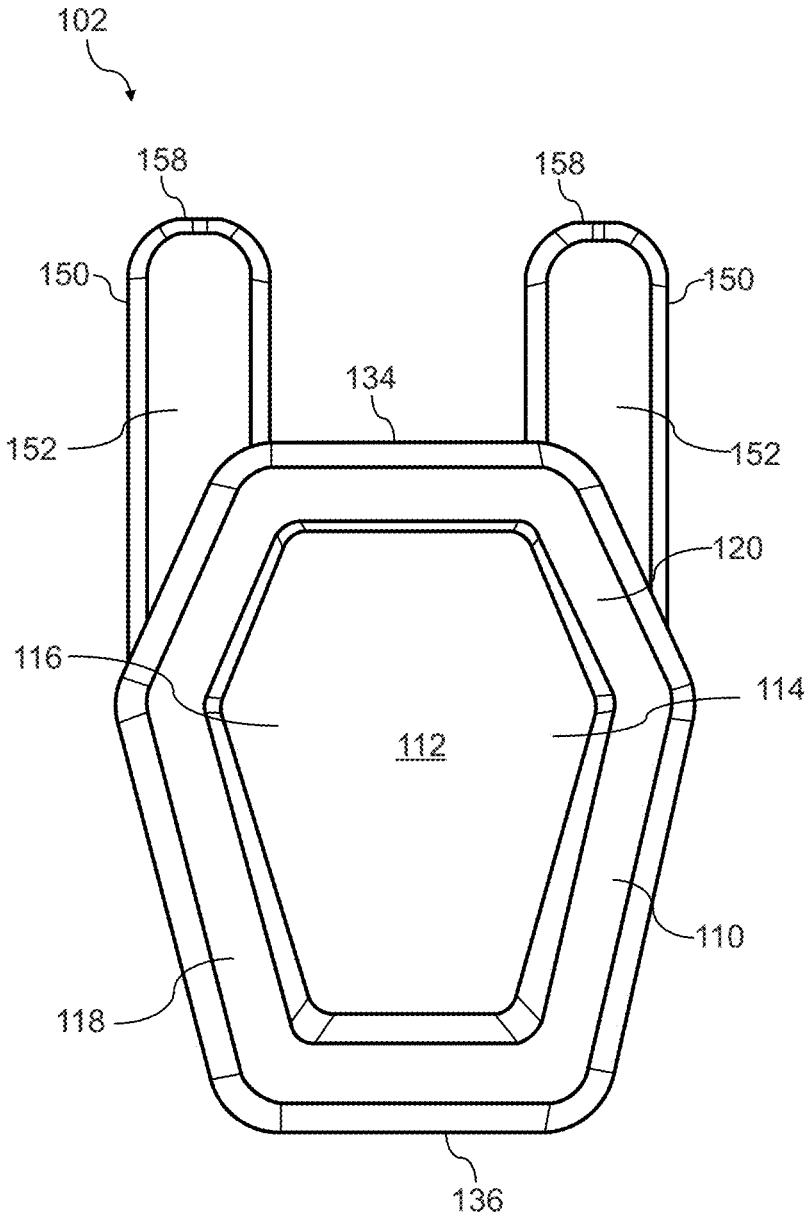
FIG. 5 illustrates a top plan view of an attachment clip according to one or more embodiments herein.
Figure 7:
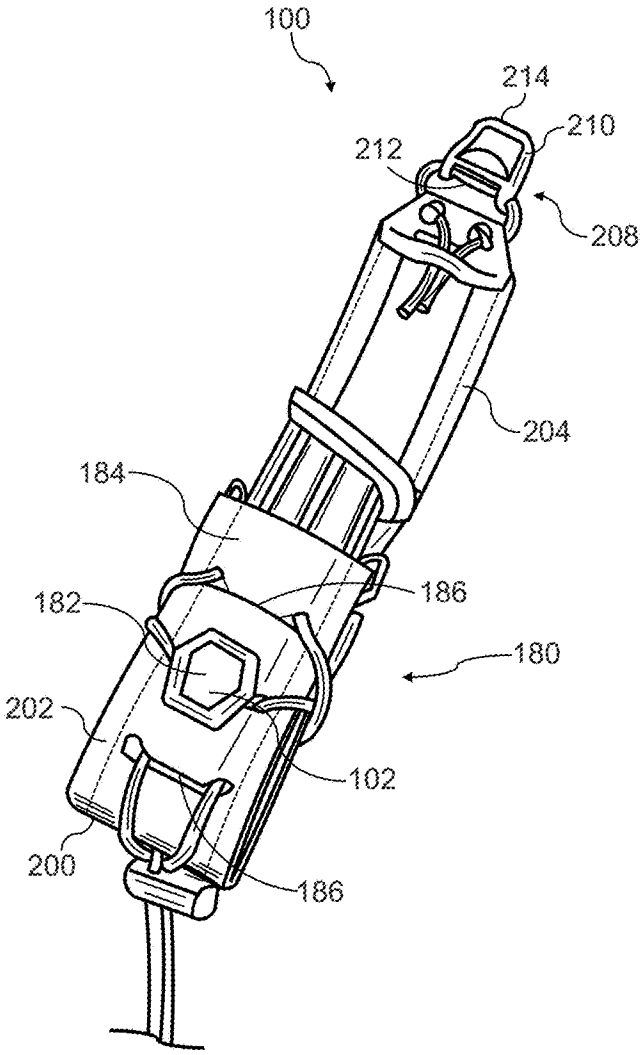
FIG. 7 illustrates a front view of an enclosure according to the embodiment of FIG. 6 herein having an attachment clip secured to a middle outer aperture that provides an anchor for a fabric flap retaining member that is unsecured from the attachment clip.
Figure 6:
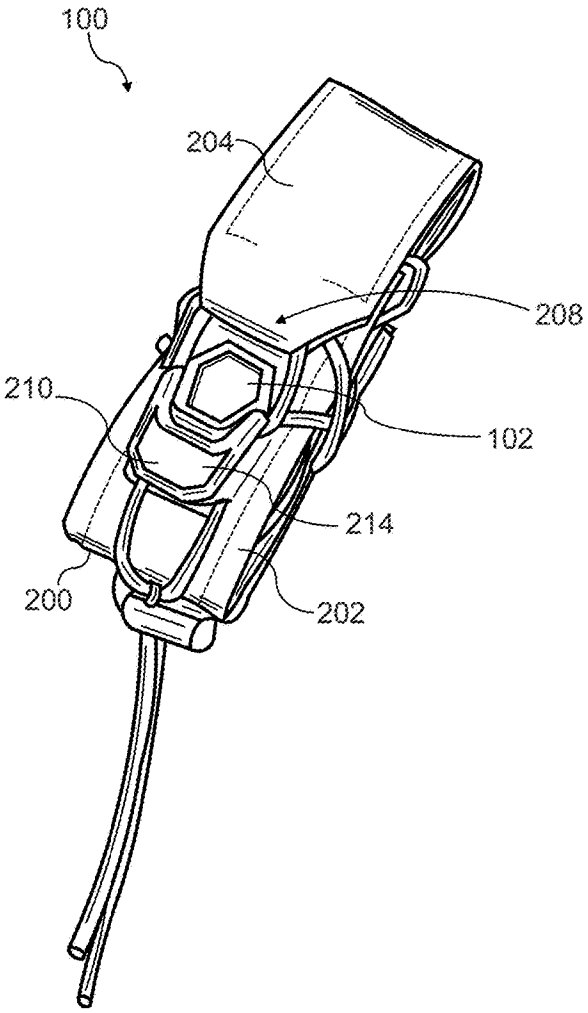
FIG. 6 illustrates a front view of an enclosure according to one or more embodiments herein having an attachment clip secured thereto that provides an anchor for a fabric flap retaining member that is secured to the attachment clip.

In embodiments, each lower planar member 150 has a forward end 158 disposed beyond the terminus 172 of the channel 170 as shown in FIG. 3. That is, a forward end 158 of each lower planar member 150 extends outward beyond the front end 134 of the upper planar member 110, as best seen in FIG. 5. Moreover, in embodiments, one or more of the catch projections 166 are disposed on an outer surface 154 closer to the forward end 158 than the rearward end 162 of the lower planar member 150. Thereby, the combination of location of the catch projections 166 and the length of the lower planar member 150 out beyond the terminus 172 of the channel 170 influences the ability to remove an attachment clip 102 with certain motions of the attachment clip 102 while still providing a stable anchor 182 on the surface layer 180 in the majority of other circumstances.

In additional embodiments, the forward end 158 of each lower planar member 150 may have a portion that is wedge shaped as shown in FIG. 3. Thereby, the forward end 158 of each lower planar member 150 may be easier to insert into outer apertures 186, such as slits, in the exterior first layer 184 and each lower planar member 150 may be easier to maneuver between the exterior first layer 184 and interior second layer 190. When inserted into the outer apertures 186, each of the lower planar members 150 is moved into a position where at least one catch projection 166 engages an inner aperture 192 in embodiments. In embodiments, the catch projection 166 extending from the outer surface 154 of a lower planar member 150 may be a tooth 168, as shown in FIG. 4. However, in various other embodiments, the catch projection 166 may be a post, bump, ridge, or other structure shaped and sized to engage an inner aperture 192. In further embodiments, there may be multiple catch projections 166 oriented in series, such as in a row or line or teeth 168, which all may individually be inserted within one or multiple inner apertures 192. Indeed, in the embodiment shown in FIG. 4, multiple teeth 168 in a row may allow all to be inserted into a single inner aperture 192 so that the attachment clip 102 is more secure from twisting and accidental disengagement than when a single catch projection 166 is engages an inner aperture 192. Indeed, removal of an attachment clip 102 having a lower planer member 150 with a series of teeth 168, as in FIG. 4 would involve several intentional manipulations of the attachment clip 102 before it is disengaged. Alternatively, each of the catch projections 166 may each engage a single respective inner aperture 192, thereby allowing for multiple points of connection that may enhance how secure an attachment clip 102 is once fixed along a surface layer 180.

Figure 2:
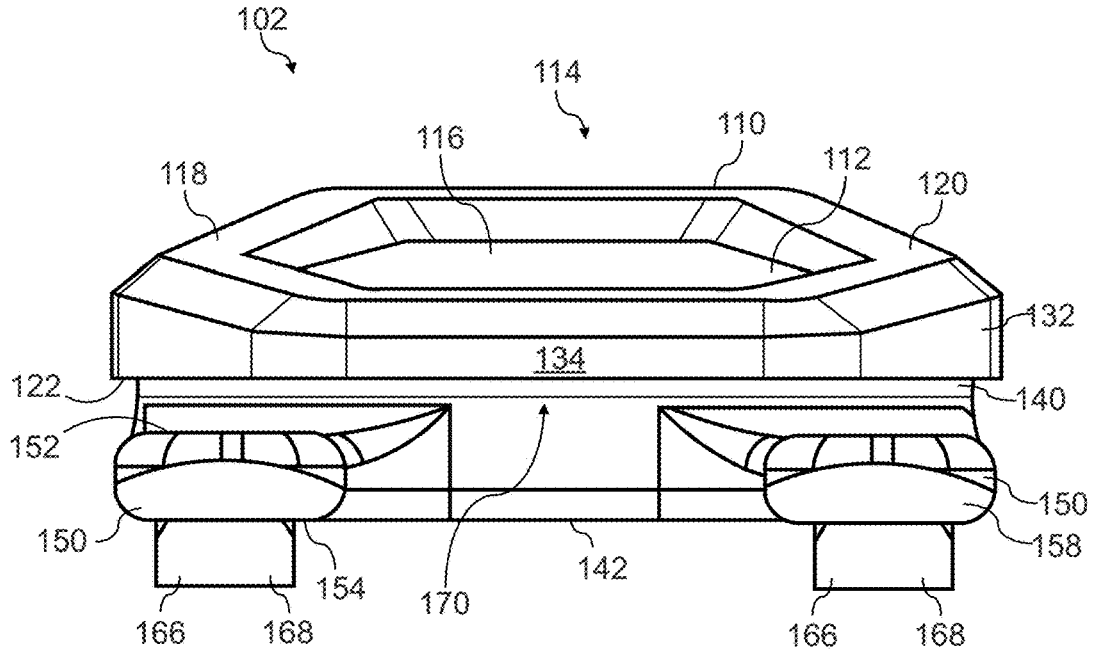
FIG. 2 illustrates a front elevation view of an attachment clip according to one or more embodiments herein.

As specified earlier, the lower planar member 150 is affixed to the attachment clip 102 such that a channel 170 is defined between a portion of the bottom surface 122 of the upper planar member 110 and a portion of the inner surface 152 of the lower planar member 150 as visible in FIG. 2. In embodiments, a rearward end 162 of the lower planar member 150 is affixed to a side of the extension member 140 or affixed to an end 142 of the extension member 140 and extends away therefrom to define a perimeter of the channel 170. In specific embodiments, the lower planar member 150 may be affixed so that it extends at an angle such that the channel 170 is tapered and the distance between the inner surface 152 and bottom surface 122 closer to the extension member 140 is greater than the distance between the same surfaces at the terminus 172 of the channel 170. In alternative embodiments, the channel 170 may be tapered in an opposite manner.

Enclosure

In addition to the descriptions provided above, additional details regarding the enclosure 200 are provided. The term enclosure, as used herein, is meant to identify multiple structures such as bags, pouches, carriers, and other holders having at least one mouth to insert and remove items. In embodiments, the attachment clip 102 may provide an anchor 182 on a surface layer 180 along and exterior wall 202 of an enclosure 200, as shown in FIGS. 6-7 and 9-15. That is, the enclosure 200 comprises at least one exterior wall 202 and at least a portion of the at least one exterior wall 202 has multiple layers, including at least an exterior first layer 184 and adjacent interior second layer 190. Indeed, in embodiments, the first layer 184 has outer apertures 186, such as slits, and the inner apertures 192, such as shown in the partially deconstructed wall of the carrier shown in FIGS. 16 and 17. Although the outer apertures 186 are shown as slits, the outer apertures 186 can be holes of varying shapes in other embodiments. Similarly, inner apertures 192 may be of varied shapes and, in certain embodiments, match a cross section of a particular catch projection 166.

In embodiments, the enclosure 200 may comprise a first layer 184 that is a flexible material, such as a fabric which provides a slightly greater ability to move a lower planar member 150 when disposed between an outer first layer 184 and interior second layer 190. In contrast, the interior second layer 190 may be a semi-rigid panel, such as a panel made of plastic, in embodiments. Indeed, in embodiments, second layer 190 may be at least rigid enough to secure catch projections 166 within the inner apertures 192. In embodiments, the outer apertures 186 and inner apertures 192 may be laser cut into each respective layer to ensure a predefined shape and size.

Furthermore, in embodiments, the first layer 184 and second layer 190 forming the surface layer 180 may be connected together in a variety of ways, including stitching along portions of the periphery thereof. In embodiments, the first layer 184 may be affixed to the second layer 190 such that the first layer 184 has segments, such as around the outer apertures 186, which slightly bow out and away from the second layer 190. Thereby, it might be easier for a user to insert a lower planar member 150 into an outer aperture 186 in the first layer 184 and to move the inserted lower planar member 150 therein. In the alternative, the first layer 184 may be generally adjacent to the second layer 190, without any bowing, particularly (but not only) in circumstances where the first layer 190 is flexible. Moreover, the layers 184, 190 may be attached together in more locations than just around portions of the periphery, such as in instances involving midline stitching segments shown in FIGS. 14 and 15. Moreover, stitching of midline segments may help provide bowing in certain desired locations in embodiments.

Figure 12:
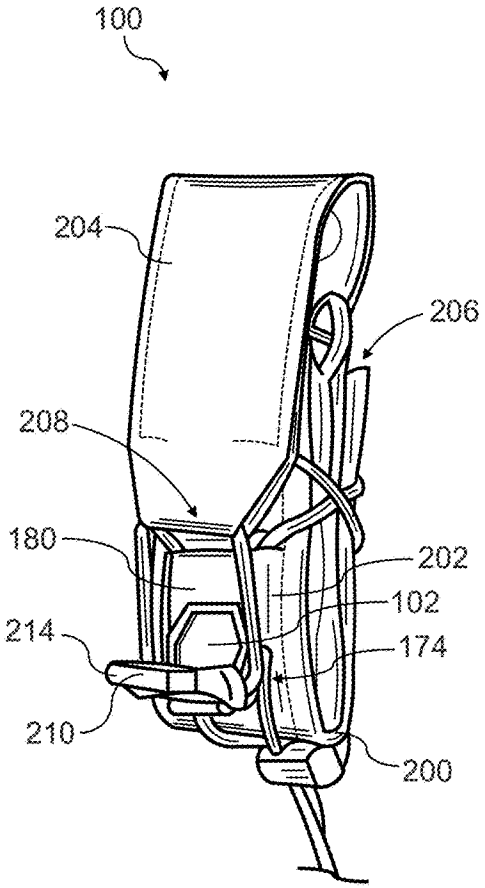
FIG. 12 illustrates a front perspective view of an enclosure according to the embodiment of FIG. 11 herein wherein the tab is mid-articulating motion from a first position, shown in FIG. 11, to a second position, shown in FIG. 12, wherein the articulating motion will release the tab of a retaining member from being secured to the attachment clip.
Figure 11:
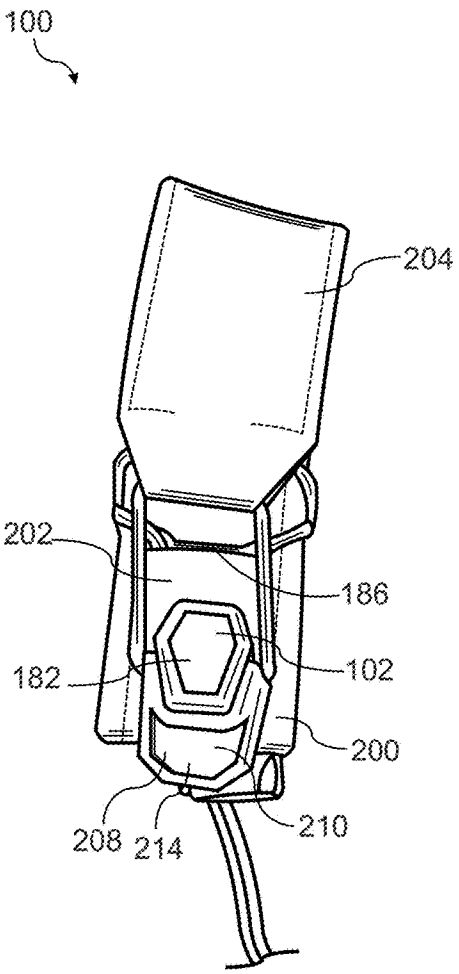
FIG. 11 illustrates a front view of an enclosure according to the embodiment of FIG. 10 herein having an attachment clip secured to the bottom outer aperture that provides an anchor for a tab of a retaining member that is secured to the attachment clip.
Figure 13:
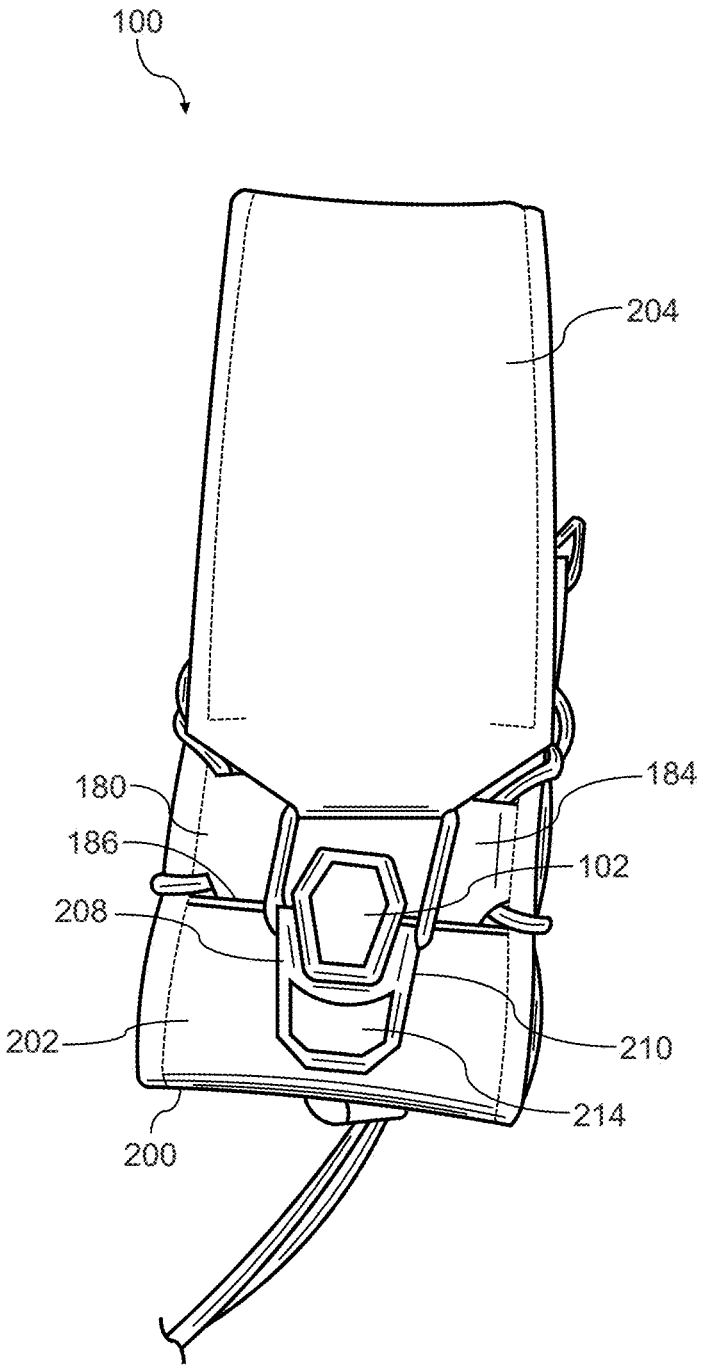
FIG. 13 illustrates a front view of an enclosure according to one or more embodiments herein having an attachment clip secured thereto that provides an anchor for a fabric flap retaining member which is secured to the attachment clip.
Figure 15:
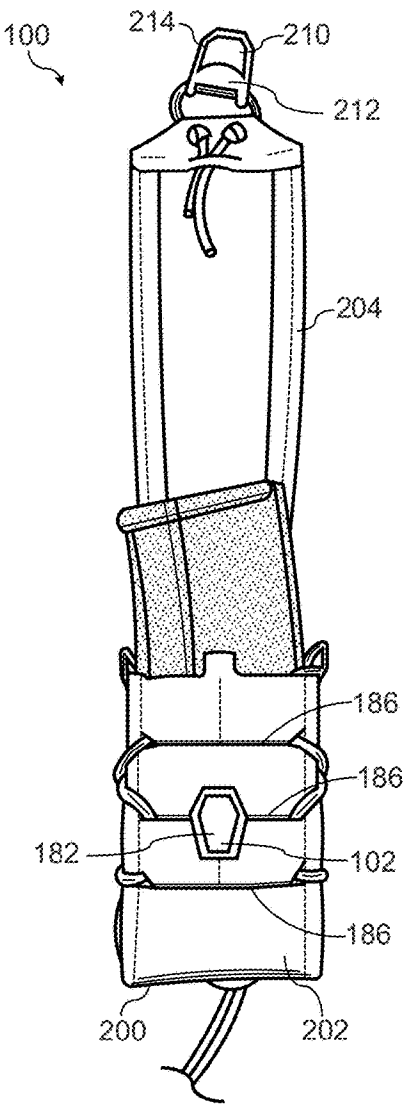
FIG. 15 illustrates a front view of an enclosure according to the embodiment of FIG. 13 herein having an attachment clip secured to a middle outer aperture that provides an anchor for a fabric flap retaining member that is unsecured from the attachment clip.
Figure 14:
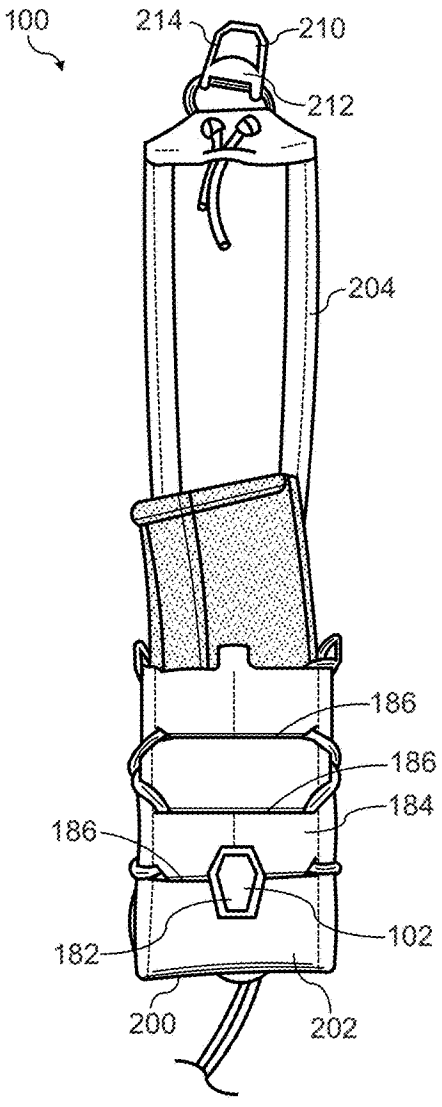
FIG. 14 illustrates a front view of an enclosure according to the embodiment of FIG. 13 herein having an attachment clip secured to a bottom outer aperture that provides an anchor for a fabric flap retaining member that is unsecured from the attachment clip.
Figure 23C:
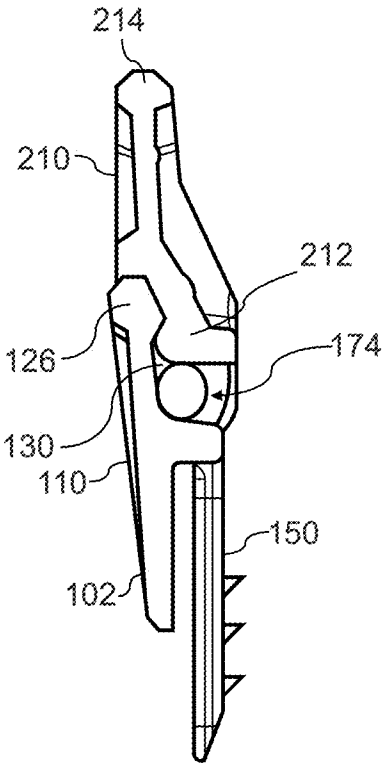
FIGS. 23A, 23B, and 23C illustrate various views of an attachment clip mated with a tab that can be affixed to a retaining member according to one or more embodiments herein demonstrating their interaction including how an insert portion of the tab that interacts with an anchor surface within anchor passage, defined by surfaces of the attachment clip and a first layer of a surface layer when the attachment clip is secured.
Figure 23B:
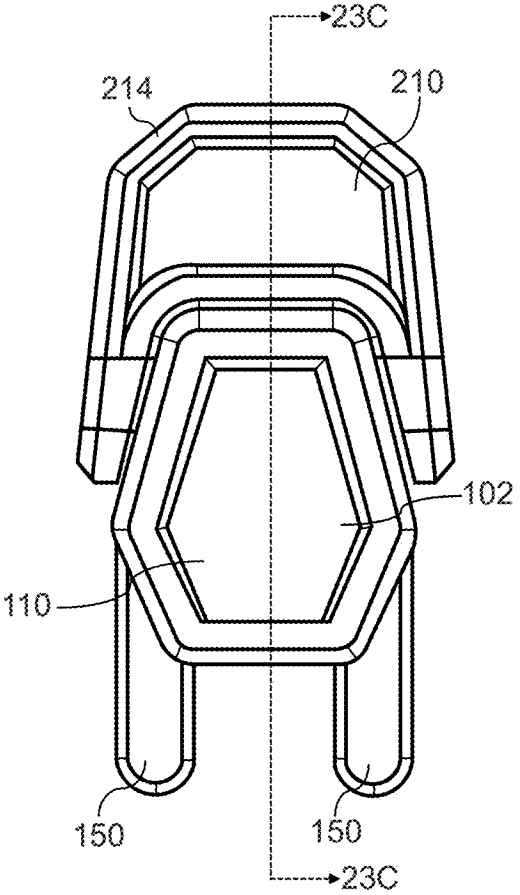
Figure 23A:
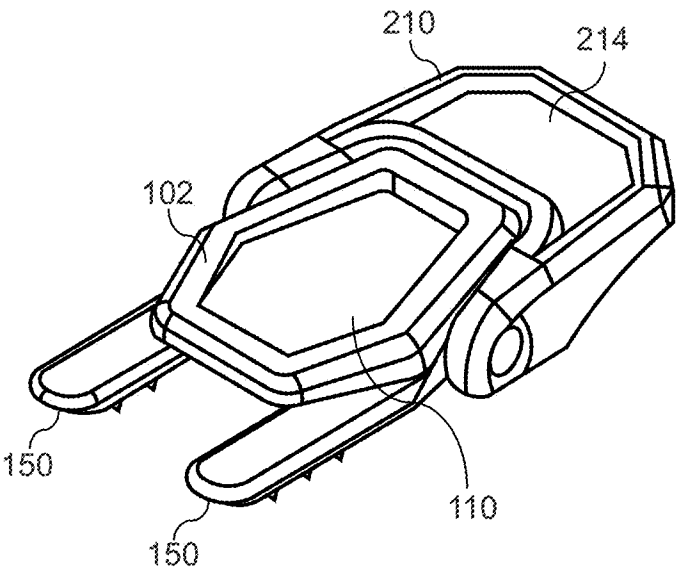
Figure 24A:
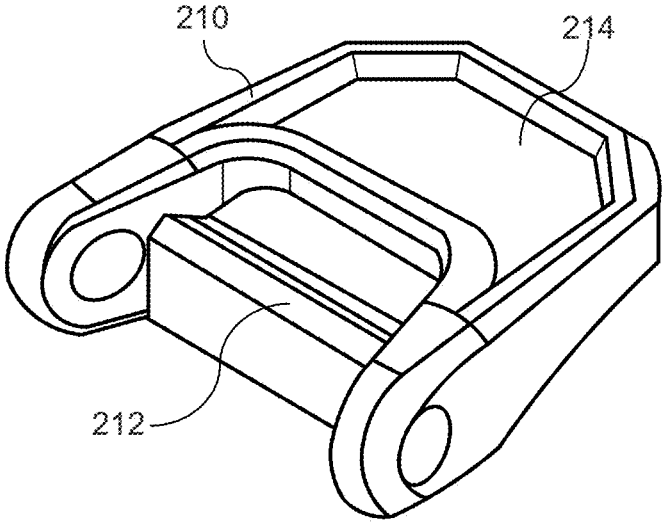
FIGS. 24A, 24B, 25A, 25B, and 25C illustrate various views of a tab that can be affixed to a retaining member according to the embodiment of FIGS. 23A-23C showing the insert portion and extension segment.
Figure 24B:
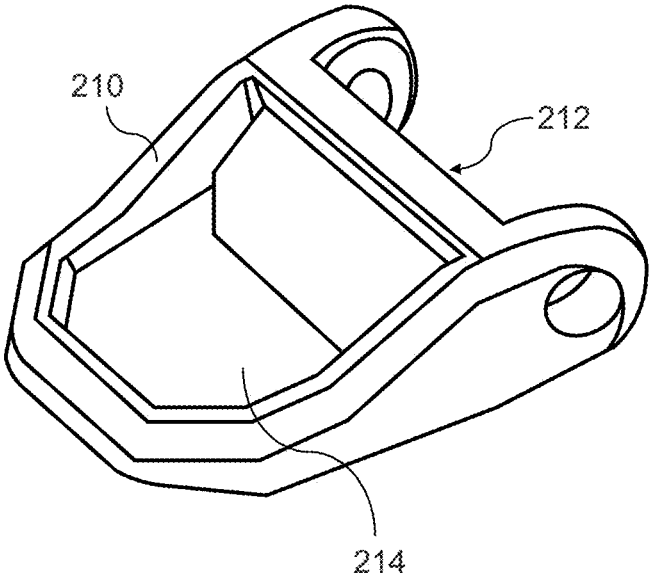
Figure 25C:
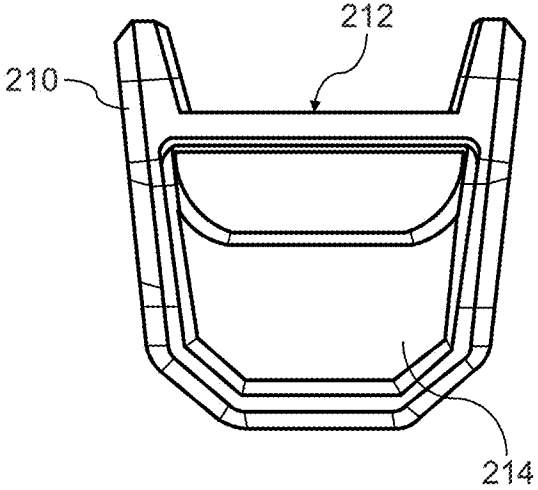
Figure 25B:
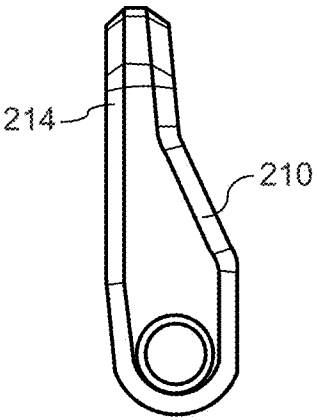
Figure 25A:
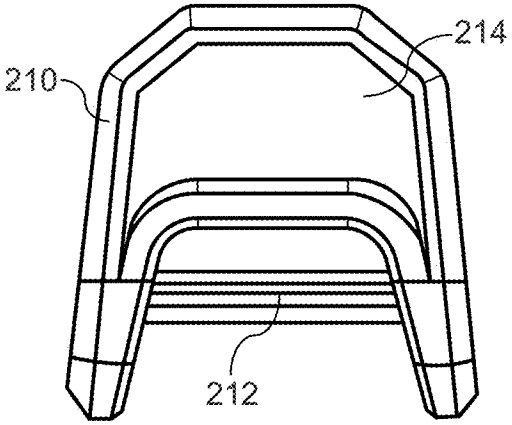

In embodiments, the enclosure 200 further comprises a retaining member 204 to cover a mouth of the enclosure 200 to retain materials placed therein as shown in FIGS. 6-15. In further embodiments, the retaining member 204 comprises two opposed ends, a first end 206 affixed to the enclosure 200 on an opposed side of the enclosure 200 from the surface layer 180, and a second end 208 which is configured to be affixable to the attachment clip 102. In embodiments, the second end 208 comprises a stretchable cord whereby tension can be provided to bias the second end 208 in contact with the anchor surface 130 within an anchor passage 174. Moreover, in embodiments, the second end 208 further comprises a pull tab 210 affixed to the stretchable cord, such as the tab 210 shown in FIGS. 24A-25C. In embodiments the pull tab 210 has an insert portion 212 to engage with the anchor passage 174, such as shown in FIGS. 23A-23C. Indeed, as shown in FIGS. 23A-23C, the pull tab 210 may have a shape and size to nest with the attachment clip 102, including any protuberance 126 therefrom. In embodiments, the tab 210 may have a portion, such as an extension segment 214, that can be articulated such as shown in FIG. 12, to disengage the tab 210 from the anchor passage 174. In embodiments, the extension segment 214 can have grip elements, the same as or similar to those discussed with respect to the top surface 112 of the upper planar member 110. Indeed, similar features (unnumbered) are shown in FIGS. 24A and 24B. In embodiments, these features are useful to provide for enhanced grip of the tab 210 so that it can be maneuvered and articulated, such as into and out of the anchor passage 174.

Figure 19:
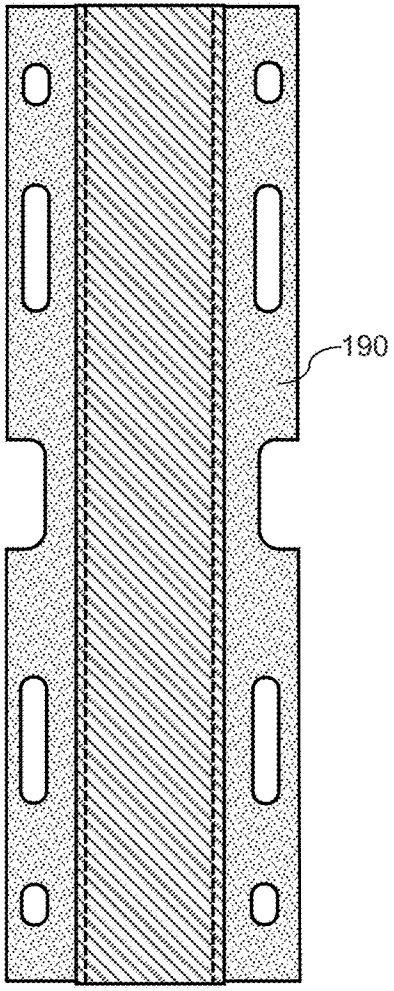
FIG. 19 illustrates an opposed inner side of a second layer according to the embodiment of FIG. 18 herein showing a segment of hook and loop fastener affixed thereto which aids insertion of items to the carrier and provides for one end of the fabric retaining member to be removably secured to the carrier on an opposed side of the mouth from the attachment clip.
Figure 18:
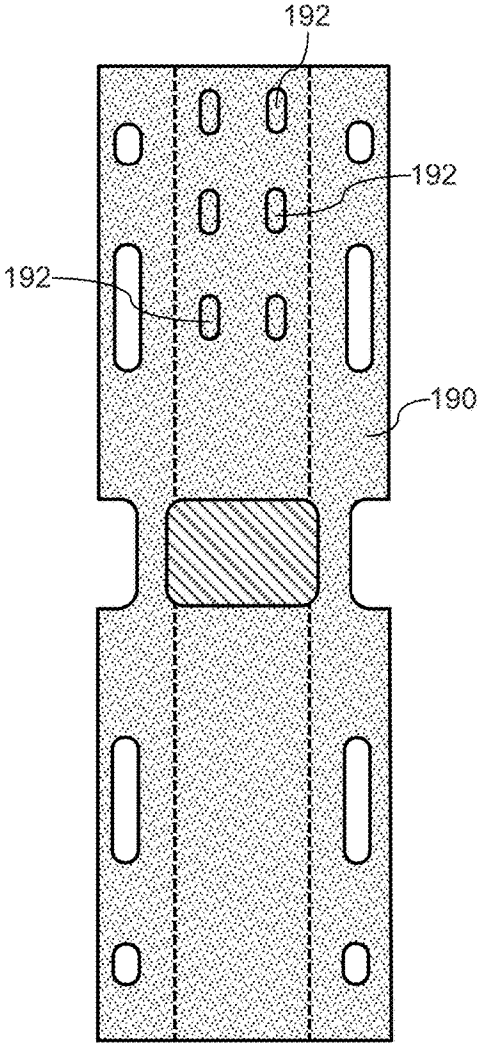
FIG. 18 illustrates an outer side view of a second layer, which along with the first layer forms the surface layer, showing the apertures therein which can be utilized by catch projections on the lower planar members.
Figure 20:
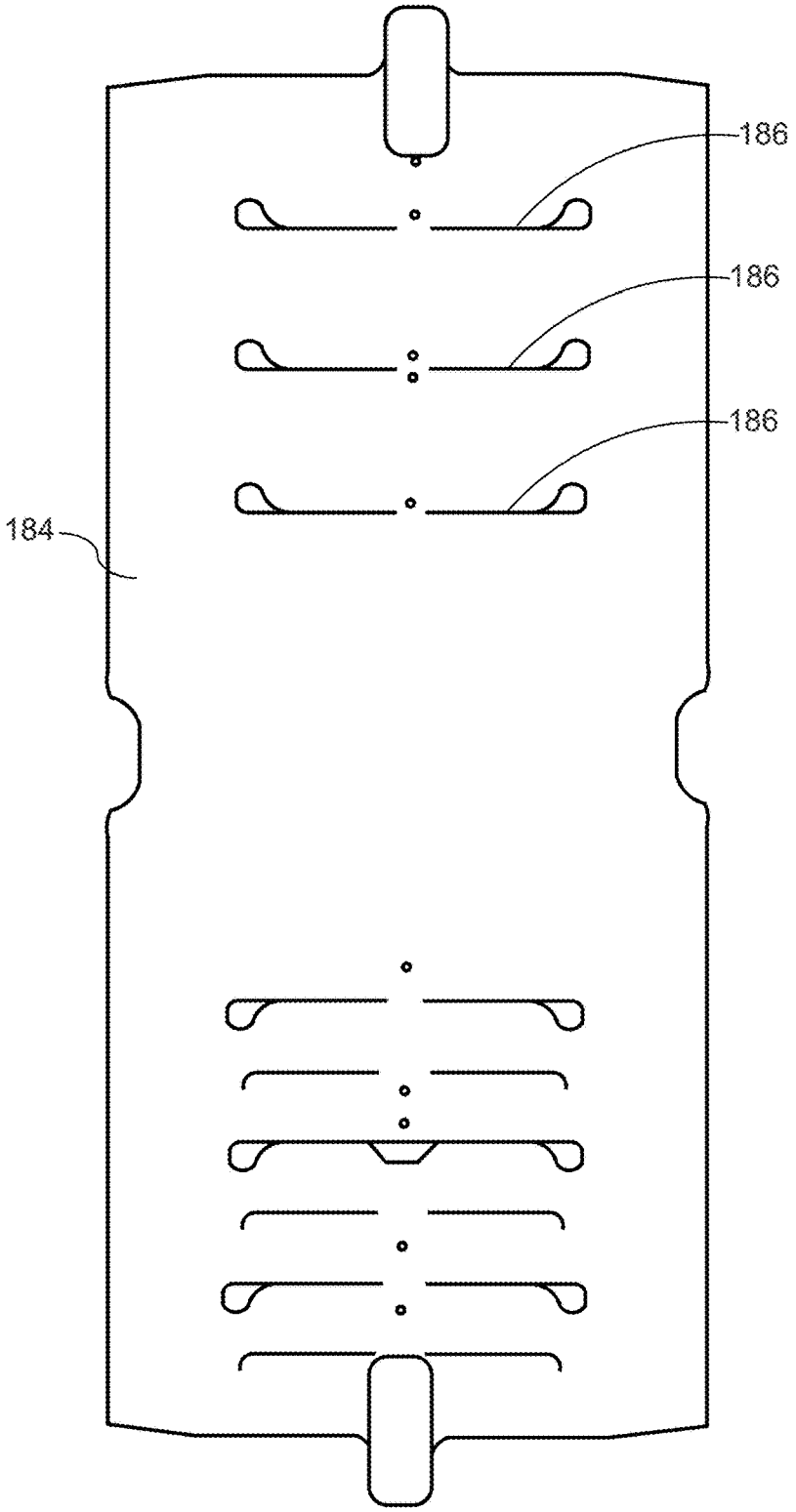
FIG. 20 illustrates an exterior side view of a first layer of a surface layer according to one or more embodiments herein showing outer apertures therein into which lower planar members may be inserted.
Figure 22:
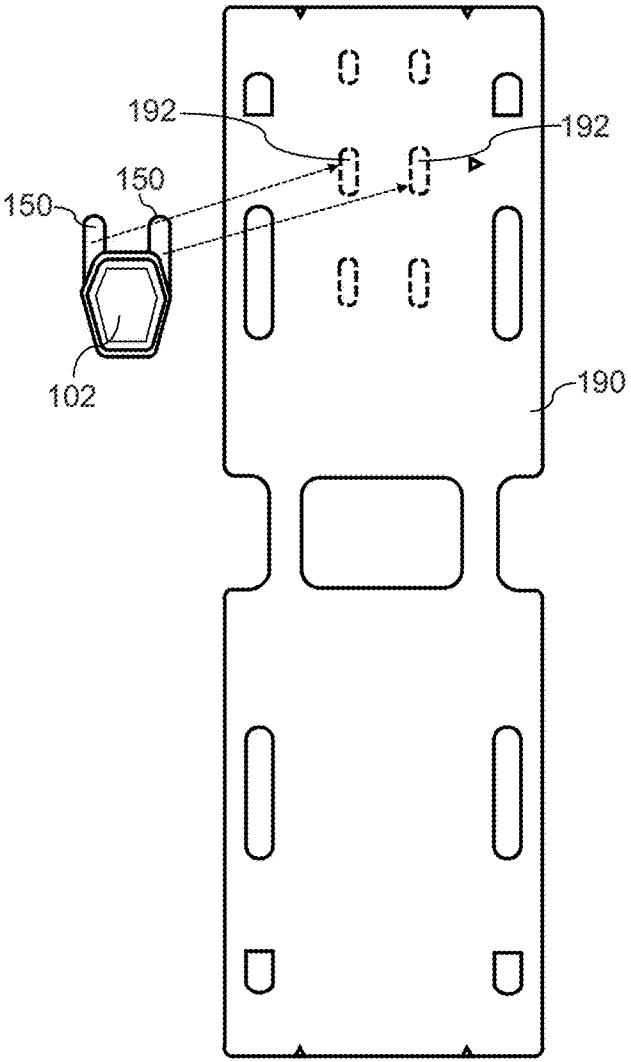
FIGS. 21 and 22 illustrate diagrams of a second layer of a surface layer according to one or more embodiments herein and showing the inner apertures thereupon and identifying the portions of the attachment clip, the lower planar members and catch projections thereon, which interact with the inner apertures.
Figure 21:
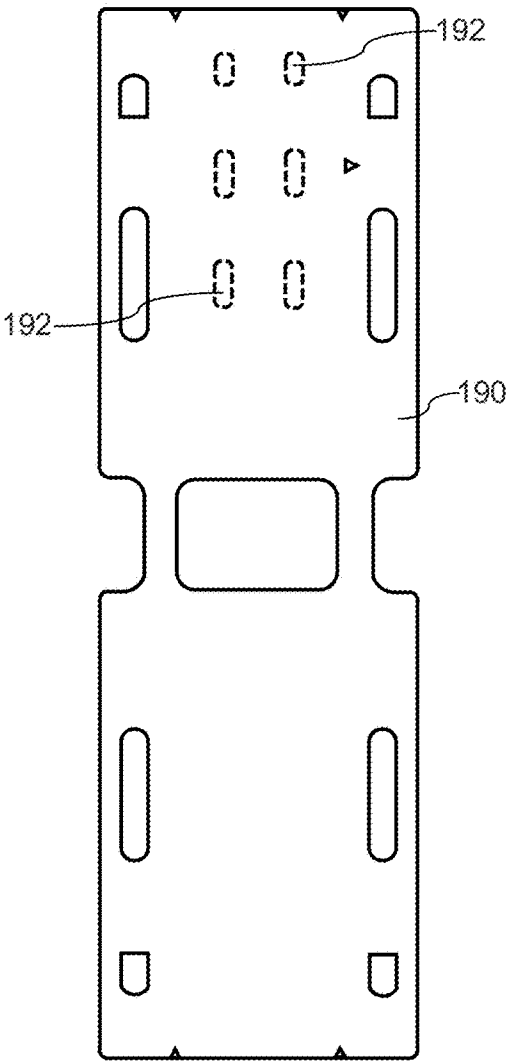

In further embodiments, the first end 206 of the retaining member 204 is releasably connected to the enclosure 200, such as by having a portion of a hook and loop fastener disposed at a first end 206 that mates with a hook and loop fastener portion affixed to one of the layer 184, 190, as shown in FIG. 19. In embodiments, the retaining member 204 comprises a flexible fabric flap as in FIG. 7, to cover the enclosure 200 mouth and an object inserted therein, as in FIG. 6.

Figure 9:
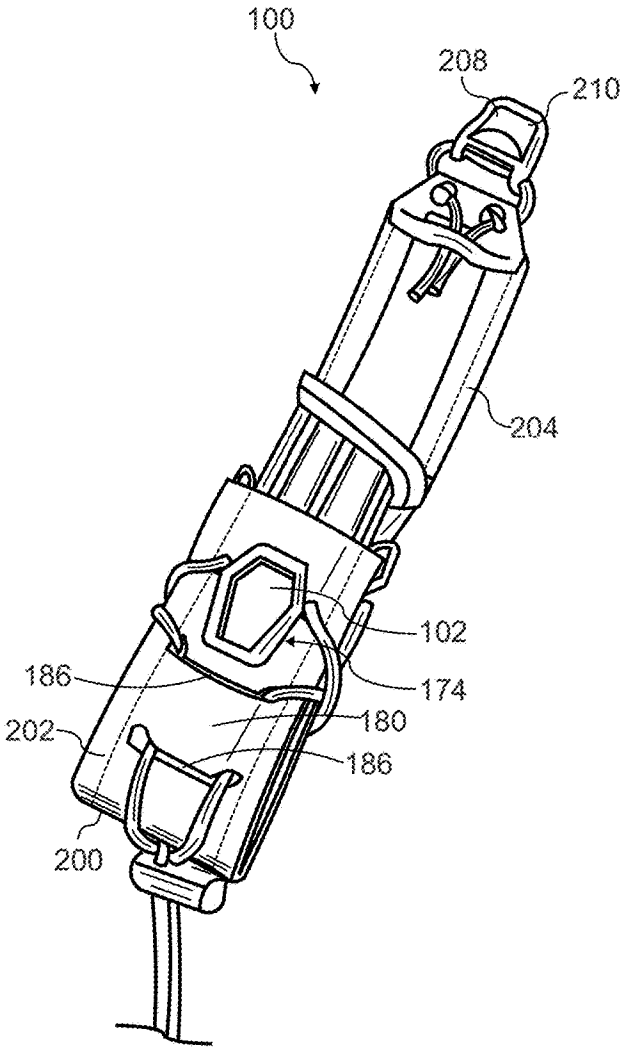
FIG. 9 illustrates a front view of an enclosure according to the embodiment of FIG. 6 herein having an attachment clip secured to a top outer aperture that provides an anchor for a fabric flap retaining member that is unsecured from the attachment clip.
Figure 8:
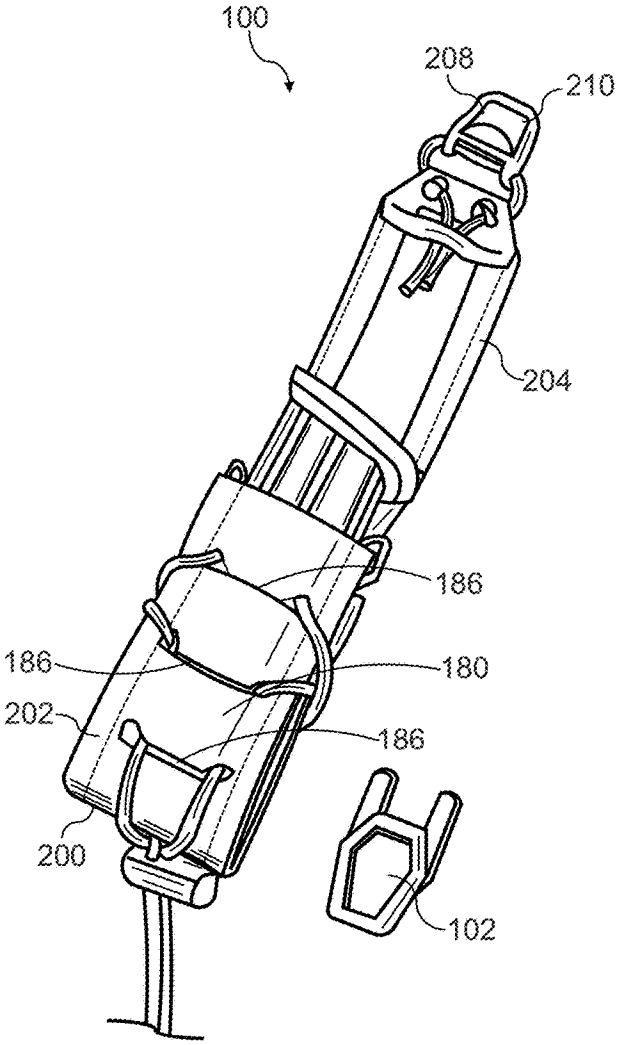
FIG. 8 illustrates a front view of an enclosure according to the embodiment of FIG. 7 herein having an attachment clip unsecured as it might be to be resecured to another portion of the enclosure.
Figure 10:
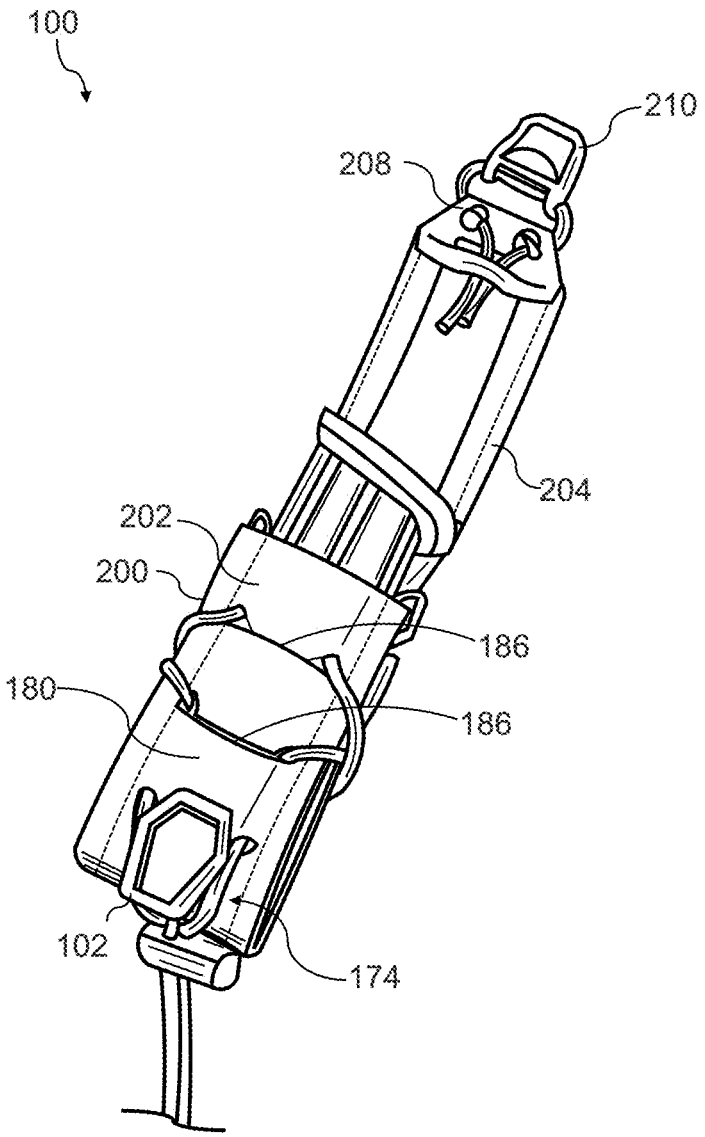
FIG. 10 illustrates a front view of an enclosure according to the embodiment of FIG. 6 herein having an attachment clip secured to a bottom outer aperture that provides an anchor for a fabric flap retaining member that is unsecured from the attachment clip.

In embodiments, the enclosure 200 may have multiple pairs of offset apertures 186, 192 along the various layer 184, 190 at various locations along a exterior wall 202 wherein an attachment clip 102 may be removably connected at various points, such as shown in FIGS. 9 and 10. Thereby, a retaining member 204 of a particular length may be utilized to cover a variety of different sized objects inserted into the enclosure 200 without removal and reattachment of the first end 206 of the retaining member 204. For example, an attachment clip 102 disposed through a middle slit, such as in FIG. 7, may allow the flap to be secured over a standard sized double stack magazine and be secured to the anchor passage 174 established by the attachment clip 102. Alternatively, an attachment clip 102 disposed through an upper slit, such as in FIG. 9, may allow the flap to be secured over an extended size magazine and be secured to the anchor passage 174 established by the attachment clip 102. In a further alternative, an attachment clip 102 disposed through a lower slit, such as in FIG. 10, may accommodate a standard sized single stack magazine and be secured to the anchor passage 174 established by the attachment clip 102. Thereby, the attachment clip system 100 having an enclosure 200 and attachment clip 102 and retaining member 204 can accommodate multiple variable circumstances with a single combination in embodiments. Additionally, certain outer apertures 186, such as slit openings in the first layer 190, can accommodate multiple lower planar members 150 in embodiments, such as in FIG. 7. However, in embodiments, a single outer aperture 186 may accommodate a single lower planar member 150 such as in FIG. 14.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. An attachment clip system to provide a temporary stable anchor along a surface layer, wherein the surface layer has at least a first layer with at least one outer aperture and a second layer with at least one inner aperture offset from the at least one outer aperture in a direction parallel to the first layer and the second layer, wherein the attachment clip system includes an attachment clip comprising:

an upper planar member comprising a top surface and a bottom surface joined by a perimeter edge, and wherein the upper planar member further comprises a front end comprising a first portion of the perimeter edge and a back end comprising a second portion of the perimeter edge disposed on an opposed side of the upper planar member from the front end;

an extension member, wherein the extension member is affixed to the bottom surface and has a first end that protrudes away from the upper planar member at a segment of the bottom surface between the front end and rear end of the upper planar member;

at least one lower planar member, each lower planar member comprising an inner surface and an outer surface joined together by a peripheral edge, and wherein the lower planar member further comprises a forward end comprising a first region of the peripheral edge and a rearward end comprising a second region of the peripheral edge disposed on an opposed side of the lower planar member from the forward end, wherein the rearward end of each lower planar member is affixed to the extension member adjacent the first end thereof such that the bottom surface of the upper planar member and the inner surface of the at least one lower planar member are disposed a space apart from each other, and at least one catch projection extending away from the outer surface; and a channel defined in the space between the bottom surface and the inner surface, the channel further defined by the extension member and an open terminus between the front end of the upper planar member and the inner surface of the lower planar member, whereby the attachment clip is secured to the surface layer when each of the at least one lower planar member is inserted between the first layer and second layer through a respective outer aperture and disposed so that a respective catch projection is disposed within a respective inner aperture and a portion of the first layer is disposed within the channel.

2. The attachment clip system of claim 1, further comprising a grip element disposed along the top surface of the upper planar member.

3. The attachment clip system of claim 2, wherein the grip element comprises a depression into the top surface of the upper planar member.

4. The attachment clip system of claim 2, wherein the grip element comprises a ridge along the top surface of the upper planar member.

5. The attachment clip system of claim 2, wherein the grip element comprises a shoulder disposed from the top surface adjacent the perimeter edge.

6. The attachment clip system of claim 1, wherein the upper planar member has a tapered shape such that a distance between the top surface and bottom surface at the rear end is greater than at the front end.

7. The attachment clip system of claim 1, wherein the channel is tapered such that a distance between the bottom surface and the inner surface is greater adjacent the extension member than the terminus.

8. The attachment clip system of claim 1, wherein each lower planar member extends away from the extension member a length such that the forward end thereof is disposed on an opposed side of the terminus from the channel.

9. The attachment clip system of claim 1, wherein the forward end of each lower planar member is wedge shaped.

10. The attachment clip system of claim 1, wherein the at least one catch projection comprises one or more teeth.

11. The attachment clip system of claim 1, wherein the at least one catch projection comprises a series of projections disposed in a line between the forward end and the rearward end.

12. The attachment clip system of claim 1, wherein the at least one lower planar member comprises a first lower planar member and a second lower planar member wherein a rearward end of the first lower planar member is affixed to the extension member at a first location thereon and a rearward end of the second lower planar member is affixed to the extension member at a second location wherein the first location is disposed adjacent an opposed side of the extension member from the second location.

13. The attachment clip system of claim 1, further comprising a protuberance disposed along the bottom surface of the upper planar member at a location adjacent the back end.

14. The attachment clip system of claim 13, wherein the protuberance comprises a tooth.

15. The attachment clip system of claim 14, wherein the tooth extends between two opposed portions of the perimeter edge of the upper planar member.

16. The attachment clip system of claim 13, wherein an anchor surface is defined along a section of the bottom surface between the extension member and the protuberance.

17. The attachment clip system of claim 16, wherein the surface layer comprises a portion of an exterior wall of an enclosure.

18. The attachment clip system of claim 17, further comprising a retaining member having a first end affixed along an exterior of the enclosure on a side thereof opposite the portion of the exterior wall comprising the surface layer, wherein the retaining member further comprises a second end on an opposite side of retaining member from the first end thereof, and wherein the retaining member is secured to the attachment clip when a portion of the second end is disposed between the first layer and the anchor surface.

19. The attachment clip system of claim 18, wherein at least a portion of the retaining member is stretchable and wherein the second end of the retaining member is biased into contact with the anchor surface to secure the retaining member in a position relative to the enclosure.

20. The attachment clip system of claim 19, wherein the second end comprises a pull tab having an insert portion configured to mate within a space between the anchor surface and the first layer.

21. The attachment clip system of claim 20, wherein the pull tab further comprises an extension segment protruding away from the insert portion and configured so that movement of the extension segment away from the first layer generates movement of the insert portion out of the space between the anchor surface and the first layer.

* * * * *